US007124999B1

(12) United States Patent
Lai

(10) Patent No.: US 7,124,999 B1
(45) Date of Patent: Oct. 24, 2006

(54) SWITCH VALVE HAVING A LOCKING EFFECT

(75) Inventor: Hung-Lin Lai, Changhua Hsien (TW)

(73) Assignee: Wen Sheng Fu Co., Ltd., Lu Kang (TW)

( * ) Notice: Subject to any disclaimer, the term of this patent is extended or adjusted under 35 U.S.C. 154(b) by 0 days.

(21) Appl. No.: 11/092,440

(22) Filed: Mar. 29, 2005

(51) Int. Cl.
*F16K 51/00* (2006.01)

(52) U.S. Cl. ..... 251/288; 137/382.5

(58) Field of Classification Search ..... 251/286, 251/288; 137/382, 382.5
See application file for complete search history.

(56) References Cited

U.S. PATENT DOCUMENTS 3,453,655 A * 7/1969 Quinones et al. ..... 137/296
3,687,414 A * 8/1972 Petty ..... 251/77
4,484,595 A * 11/1984 Vanek et al. ..... 137/296
6,382,590 B1 * 5/2002 Wu ..... 251/286

* cited by examiner

*Primary Examiner*—Edward K. Look
*Assistant Examiner*—John K. Fristoe, Jr.
(74) *Attorney, Agent, or Firm*—Alan D. Kamrath; Nikolai & Mersereau, P.A.

(57) ABSTRACT

A switch valve includes a valve body, a control stem rotatably mounted on the valve body to open/close a water flow in the valve body, a limit ring mounted on the valve body to encompass the control stem, and a rotation head removably mounted on the limit ring and detachably engaged with the control stem for rotating the control stem. Thus, the distal end of the control stem is only rotated by rotation of the rotation head to rotate the control stem so as to open/close the water flow in the valve body, so that the switch valve has a locking effect, thereby preventing the switch valve from being opened by a person intentionally.

10 Claims, 6 Drawing Sheets

SWITCH VALVE HAVING A LOCKING EFFECT

BACKGROUND OF THE INVENTION

1. Field of the Invention

The present invention relates to a switch valve, and more particularly to a switch valve having a locking effect.

2. Description of the Related Art

A conventional switch valve in accordance with the prior art shown in FIG. 6 comprises a valve body 10, a control stem 11 rotatably mounted on the valve body 10 to open/close a water flow in the valve body 10, and a rotation head 12 mounted on the control stem 11 for rotating the control stem 11 so as to open/close the water flow in the valve body 10. Thus, the switch valve can be closed when not in use. However, the control stem 11 is not locked by a locking device, so that the control stem 11 can be rotated freely by any person to open the water flow in the valve body 10, thereby easily wasting the water resource.

SUMMARY OF THE INVENTION

In accordance with the present invention, there is provided a switch valve, comprising a valve body, a control stem rotatably mounted on the valve body to open/close a water flow in the valve body, a limit ring mounted on the valve body to encompass the control stem, and a rotation head removably mounted on the limit ring and detachably engaged with the control stem for rotating the control stem.

The primary objective of the present invention is to provide a switch valve having a locking effect.

Another objective of the present invention is to provide a switch valve, wherein the distal end of the control stem is only rotated by rotation of the rotation head to rotate the control stem so as to open/close the water flow in the valve body, so that the switch valve has a locking effect, thereby preventing the switch valve from being opened by a person intentionally.

A further objective of the present invention is to provide a switch valve, wherein the distal end of the control stem is fully hidden in the through hole of the limit ring, so that the distal end of the control stem cannot be driven to rotate by a person's fingers or by other tool, thereby preventing the control stem from being operated freely to open the water flow in the valve body so as to save the water resource.

Further benefits and advantages of the present invention will become apparent after a careful reading of the detailed description with appropriate reference to the accompanying drawings.

DETAILED DESCRIPTION OF THE INVENTION

Figure 1:
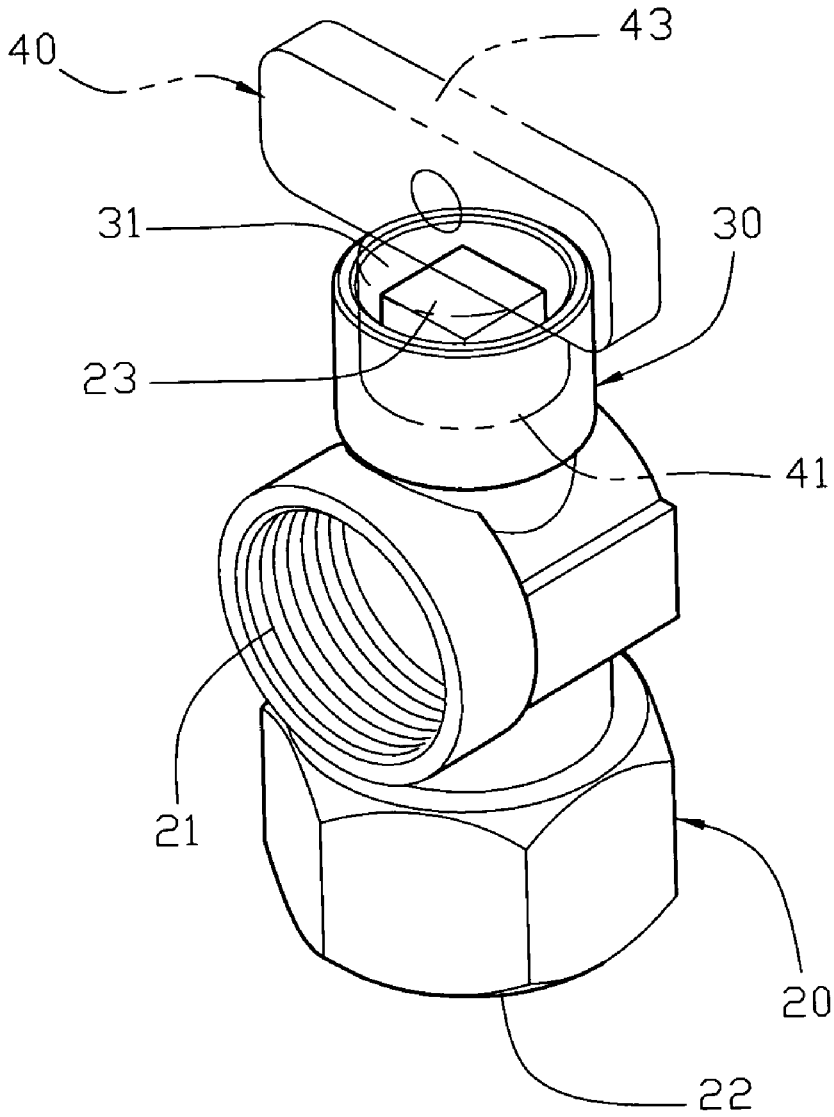
FIG. 1 is a perspective view of a switch valve in accordance with the preferred embodiment of the present invention.

Referring to the drawings and initially to FIGS. 1–4, a switch valve in accordance with the preferred embodiment of the present invention comprises a valve body 20, a control stem 23 rotatably mounted on the valve body 20 to open/close a water flow in the valve body 20, a limit ring 30 mounted on the valve body 20 to encompass the control stem 23, and a rotation head 40 removably mounted on the limit ring 30 and detachably engaged with the control stem 23 for rotating the control stem 23.

The valve body 20 has a water inlet 21 and a water outlet 22. The valve body 20 has a peripheral wall formed with a threaded locking section 24 and has a side formed with a substantially arc-shaped limit slot 25 aligning with the control stem 23. The control stem 23 has a square distal end protruding outward from the valve body 20.

A limit rod 26 is mounted in the valve body 20 and has a first end secured on the control stem 23 to move therewith and a second end slidably mounted in the limit slot 25 of the valve body 20 to limit excessive movement of the control stem 23.

The limit ring 30 has a smooth outer wall and has an inner wall formed with a through hole 31 for receiving the distal end of the control stem 23. The distal end of the control stem 23 has a height smaller than that of the through hole 31 of the limit ring 30 so that the distal end of the control stem 23 is fully hidden in the through hole 31 of the limit ring 30. The inner wall of the limit ring 30 has an end formed with a threaded locking section 32 locked on the locking section 24 of the valve body 20 to fix the limit ring 30 on the valve body 20.

The rotation head 40 has a first end formed with a circular plug 41 removably inserted into the through hole 31 of the limit ring 30 and having an inside formed with a square mounting hole 42 detachably mounted on the distal end of the control stem 23. The rotation head 40 has a second end formed with an elongated control handle 43 to facilitate a user holding the rotation head 40.

Figure 4:
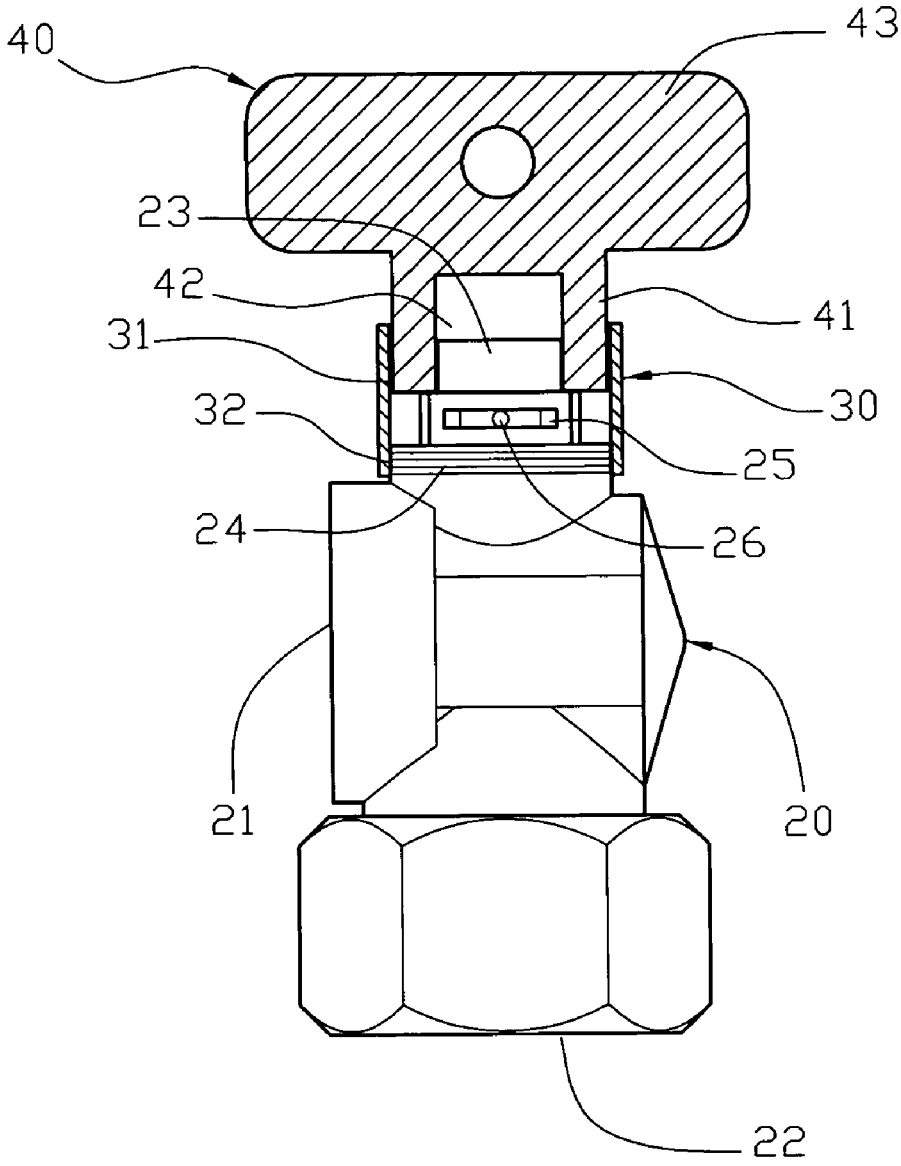
FIG. 4 is a plan cross-sectional view of the switch valve as shown in FIG. 1.

In operation, referring to FIGS. 1–5, when the rotation head 40 is mounted on the limit ring 30 as shown in FIGS. 1 and 4, the plug 41 of the rotation head 40 is inserted into the through hole 31 of the limit ring 30, and the mounting hole 42 of the rotation head 40 is mounted on the distal end of the control stem 23, so that the rotation head 40 is fixed on the distal end of the control stem 23. Thus, the distal end of the control stem 23 is rotated by rotation of the rotation head 40 to rotate the control stem 23 so as to open/close the water flow in the valve body 20.

Figure 2:
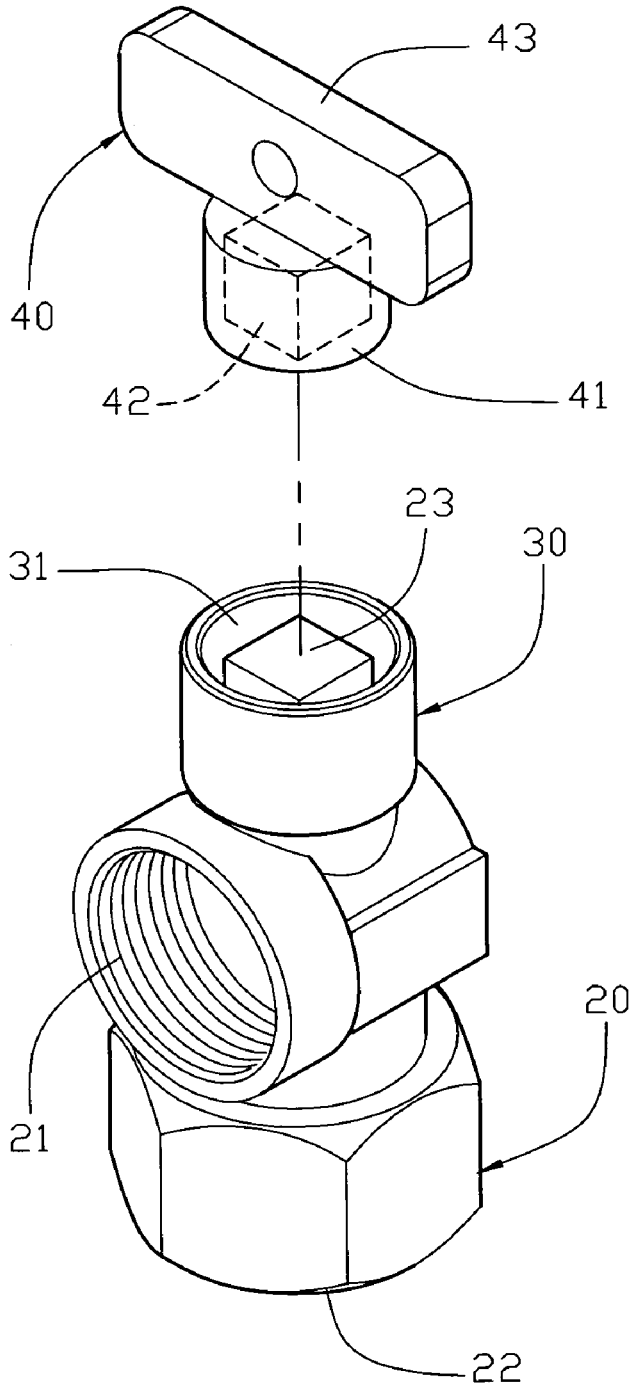
FIG. 2 is a partially exploded perspective view of the switch valve as shown in FIG. 1.
Figure 3:
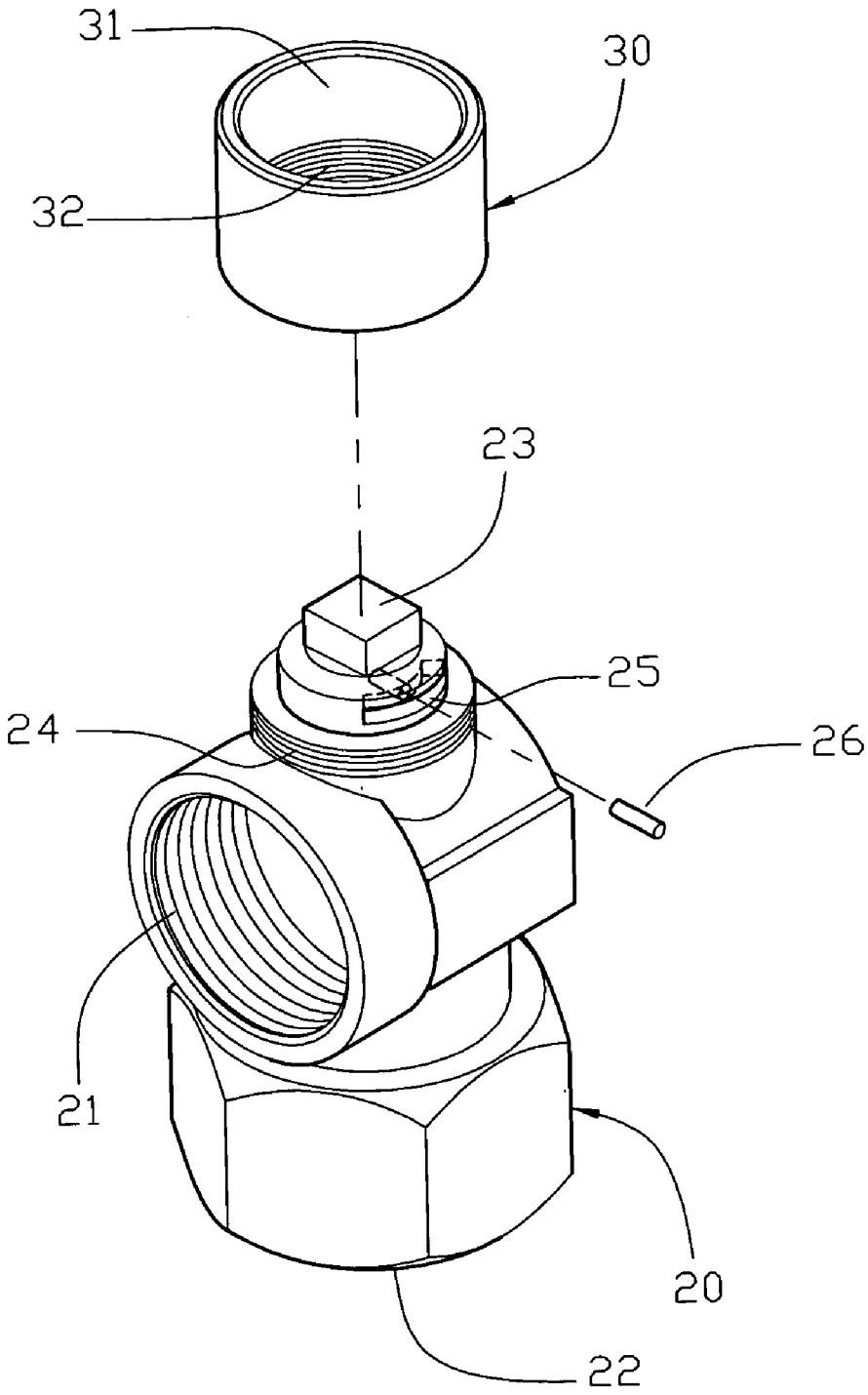
FIG. 3 is an exploded perspective view of the switch valve as shown in FIG. 1.
Figure 5:
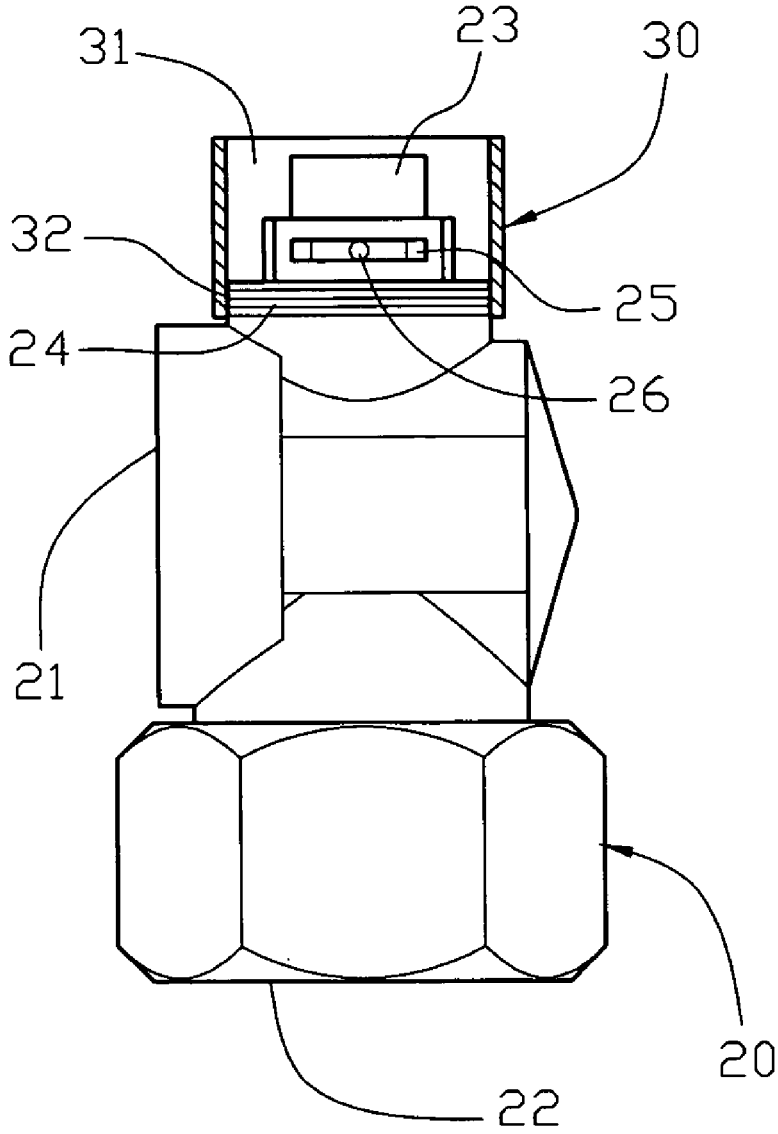
FIG. 5 is a plan cross-sectional view of the switch valve as shown in FIG. 1, wherein the rotation head is removed.
Figure 6:
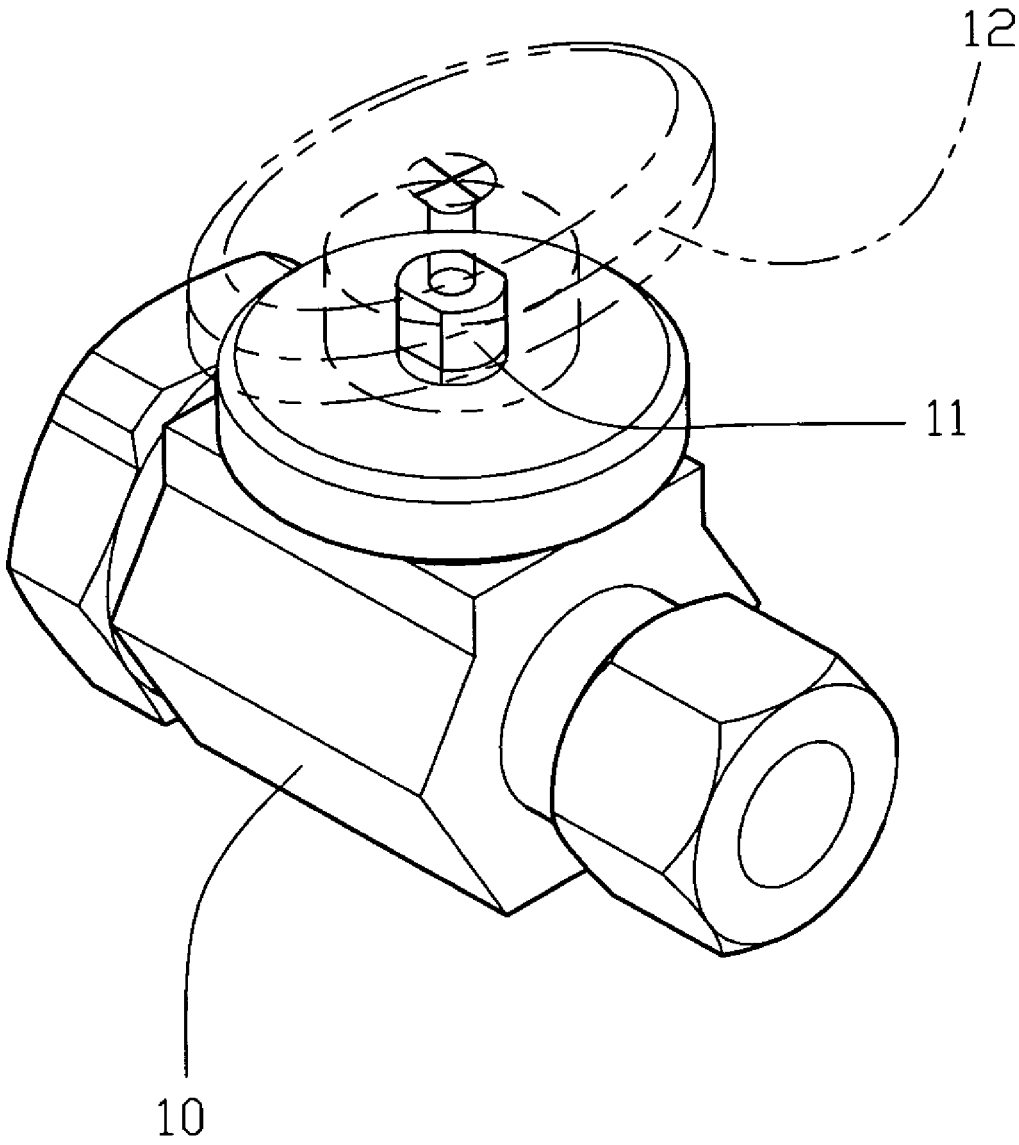
FIG. 6 PRIOR ART
FIG. 6 is a perspective view of a conventional switch valve in accordance with the prior art.

After the rotation head 40 is removed from the limit ring 30 as shown in FIGS. 2 and 5, the distal end of the control stem 23 is fully hidden in the through hole 31 of the limit ring 30, so that the distal end of the control stem 23 cannot be driven to rotate by a person's fingers or by other tool, thereby preventing the control stem 23 from being operated freely to open the water flow in the valve body 20 so as to save the water resource.

Accordingly, the distal end of the control stem 23 is only rotated by rotation of the rotation head 40 to rotate the control stem 23 so as to open/close the water flow in the valve body 20, so that the switch valve has a locking effect, thereby preventing the switch valve from being opened by a person intentionally. In addition, the distal end of the control stem 23 is fully hidden in the through hole 31 of the limit ring 30, so that the distal end of the control stem 23 cannot be driven to rotate by a person's fingers or by other tool, thereby preventing the control stem 23 from being operated freely to open the water flow in the valve body 20 so as to save the water resource.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A switch valve, comprising:

a valve body;

a control stem rotatably mounted on the valve body to open/close a water flow in the valve body;

a limit ring mounted on the valve body to encompass the control stem;

a rotation head removably mounted on the limit ring and detachably engaged with the control stem for rotating the control stem; wherein the control stem has a distal end protruding outward from the valve body;

the limit ring has an inner wall formed with a through hole for receiving the distal end of the control stem;

the distal end of the control stem is fully hidden in the through hole of the limit ring;

the distal end of the control stem has a height smaller than that of the through hole of the limit ring so that the distal end of the control stem is protected by the limit ring to prevent the distal end of the control stem from being rotated directly;

the rotation head has a first end formed with a plug removably inserted into the through hole of the limit ring and having an inside formed with a mounting hole detachably mounted on the distal end of the control stem;

the valve body has a peripheral wall formed with a threaded locking section, and the inner wall of the limit ring has an end formed with a threaded locking section locked on the locking section of the valve body to fix the limit ring on the valve body.

2. The switch valve in accordance with claim 1, wherein the valve body has a stepped side rested on a bottom of the plug of the rotation head and formed with a limit slot aligning with the control stem, and the switch valve further comprises a limit rod having a first end secured on the control stem to move therewith and a second end slidably mounted in the limit slot of the valve body to limit excessive movement of the control stem.

3. The switch valve in accordance with claim 2, wherein the limit rod is mounted in the valve body.

4. The switch valve in accordance with claim 2, wherein the limit slot of the valve body is substantially arc-shaped.

5. The switch valve in accordance with claim 1, wherein the limit ring has a smooth outer wall.

6. The switch valve in accordance with claim 1, wherein the distal end of the control stem has a square shape, and the mounting hole of the rotation head has a square shape.

7. The switch valve in accordance with claim 1, wherein the plug of the rotation head has a circular shape.

8. The switch valve in accordance with claim 1, wherein the rotation head has a second end formed with an elongated control handle to facilitate a user holding the rotation head.

9. The switch valve in accordance with claim 1, wherein the distal end of the control stem is rotated by rotation of the rotation head to rotate the control stem so as to open/close the water flow in the valve body.

10. The switch valve in accordance with claim 1, wherein the through hole of the limit ring has a space defined between the distal end of the control stem and the inner wall of the limit ring to allow insertion of the plug of the rotation head.

* * * * *